US009525927B2

(12) United States Patent
Hu et al.

(10) Patent No.: US 9,525,927 B2
(45) Date of Patent: Dec. 20, 2016

(54) EARPHONE AND FABRICATION METHOD THEREOF

(75) Inventors: Yimu Hu, Shenzhen (CN); Xiaoming Yang, Shenzhen (CN)

(73) Assignee: ZTE Corporation, Shenzhen, Guangdong (CN)

( * ) Notice: Subject to any disclaimer, the term of this patent is extended or adjusted under 35 U.S.C. 154(b) by 0 days.

(21) Appl. No.: 14/368,262

(22) PCT Filed: Mar. 8, 2012

(86) PCT No.: PCT/CN2012/072102

§ 371 (c)(1),
(2), (4) Date: Oct. 8, 2014

(87) PCT Pub. No.: WO2013/091307

PCT Pub. Date: Jun. 27, 2013

(65) Prior Publication Data

US 2015/0078608 A1 Mar. 19, 2015

(30) Foreign Application Priority Data

Dec. 21, 2011 (CN) ..... 2011 1 0432236

(51) Int. Cl.
*H04R 1/10* (2006.01)
*H04R 31/00* (2006.01)

(52) U.S. Cl.
CPC ..... *H04R 1/1033* (2013.01); *H04R 31/00* (2013.01); *H04R 2201/107* (2013.01); *Y10T 29/49005* (2015.01)

(58) Field of Classification Search
CPC ..... H04R 1/10; H04R 2205/022; H04R 1/105; H04R 5/0335; H04R 2201/10
USPC ..... 381/370, 374–375, 379, 384
See application file for complete search history.

(56) References Cited

U.S. PATENT DOCUMENTS

| | | | | |
|---|---|---|---|---|
| 2,009,314 | A | 7/1935 | Gogan | |
| 6,600,826 | B1 | 7/2003 | Xavier | |
| 7,507,908 | B1 * | 3/2009 | Wu et al. | 174/115 |
| 2007/0025579 | A1 * | 2/2007 | Kolton | H04R 1/1033 381/384 |
| 2012/0121120 | A1 * | 5/2012 | Gorzelany | 381/384 |

FOREIGN PATENT DOCUMENTS

| | | | |
|---|---|---|---|
| CN | 101449339 | A | 6/2009 |
| CN | 101567233 | A | 10/2009 |
| JP | 2003324784 | A | 11/2003 |

OTHER PUBLICATIONS

PCT Publication and International Search Report of corresponding International Application No. PCT/CN2012/072102; 14 pages.

(Continued)

*Primary Examiner* — Suhan Ni

(57) ABSTRACT

The disclosure provides an earphone and a fabrication method thereof. The earphone includes: an earphone wire, wherein the earphone wire includes flexible wire parts and hard wire parts which are arranged alternately. The technical scheme provided in the disclosure solves the problem existing in the related technologies that earphone wires entwine easily and cannot be untangled readily and therefore effectively avoids the entwining of earphone wires and improves user experience.

12 Claims, 2 Drawing Sheets

(56) References Cited

OTHER PUBLICATIONS

WIPO English translation of PCT International Search Report and Written Opinion of corresponding International Application No. PCT/CN2012/072102; mail date of Sep. 20, 2012; 8 pages.
European Patent Office, European Application No. 12859720.0. European Office Action dated Apr. 10, 2015. Name of Applicant: ZTE Corporation. English Language. 5 pages.
European Patent Office. European Application No. 12859720.0. European Office Action dated Apr. 10, 2015. Name of Applicant: ZTE Corporation. English Language. 5 pages.

* cited by examiner

EARPHONE AND FABRICATION METHOD THEREOF

TECHNICAL FIELD

The disclosure relates to the electronic field and in particular to an earphone and a fabrication method thereof.

BACKGROUND

Earphone is a common electronic component, but earphone wires entwine easily and cannot be untangled readily during the use of earphone, leading to the abandon of the use of earphone by a great many people and undermining the user experience of earphone, moreover, earphone wires, when being untangled, are easily damaged. As the use of an earphone is a great way to reduce the potential injury caused by mobile phone radiation to human body, there is a great demand for an earphone which hardly entwines. There are no such earphones on the market to meet the great demands of customers.

No effective solution has been proposed to address the problem existing in related technologies that earphone wires entwine easily and cannot be untangled readily.

SUMMARY

In view of the problem existing in related technologies that earphone wires entwine easily and cannot be untangled readily, the disclosure provides an earphone and a fabrication method thereof to at least address one of the problems above.

In accordance with an aspect of the disclosure, an earphone is provided, including: an earphone wire, wherein the earphone wire includes flexible wire parts and hard wire parts which are arranged alternately.

Preferably, the flexible wire parts and the hard wire parts are arranged in at least one of the following ways: arranging casing tubes having different hardness outside an internal guide wire of the earphone wire; arranging an integrated casing tube outside the internal guide wire of the earphone wire, wherein the integrated casing tube at positions corresponding to the hard wire parts is hardened; and coating a component which hardly entwines on the hard wire parts.

Preferably, the flexible wire pants and the hard wire parts have the same wire diameter.

Preferably, the hard wire parts further include: a first connection portion for connecting two hard wire parts detachably.

Preferably, the first connection portion includes lock catches and/or magnets which are symmetrically arranged on each two hard wire parts.

Preferably, the hard wire parts on which the lock catches are provided have the same length.

Preferably, the earphone wire includes: a first branch wire corresponding to a first earplug, a second branch wire corresponding to a second earplug and a trunk wire, and the first connection portion is arranged on the trunk wire.

Preferably, the earphone wire further includes: a first branch wire corresponding to a first earplug, a second branch wire corresponding to a second earplug and a trunk wire, wherein a second connection portion is arranged on the second branch wire, and the second connection portion is detachably connected with the trunk wire.

Preferably, the second connection portion is a plug, the earphone further includes a microphone box arranged on the earphone wire, wherein a socket matching with the plug to detachably connect the second branch wire with the trunk wire is arranged on the microphone box.

In accordance with an aspect of the disclosure, a fabrication method for an earphone is provided, including: arranging flexible wire parts and hard wire parts alternately on an earphone wire of the earphone.

Preferably, the flexible wire parts and the hard wire parts are arranged in at least one of the following ways: arranging casing tubes having different hardness outside an internal guide wire of the earphone wire; arranging an integrated casing tube outside the internal guide wire of the earphone wire, wherein the integrated casing tube at positions corresponding to the hard wire parts is hardened; and coating a component which hardly entwines on the hard wire parts.

By adopting a technical scheme in which flexible wire parts and hard wire parts are alternately arranged on an earphone wire, the disclosure solves the problem existing in related technologies that earphone wires entwine easily and cannot be untangled readily and therefore effectively avoids the entwining of earphone wires and improves user experience.

BRIEF DESCRIPTION OF THE DRAWINGS

The accompanying drawings described here are provided for a better understanding of the disclosure and form one part of the disclosure, and the exemplary embodiments of the disclosure and the description thereof are illustrative of the disclosure but are not to be construed as limiting the disclosure. In the accompanying drawings.

DETAILED DESCRIPTION OF THE EMBODIMENTS

The disclosure is described below in detail with reference to accompanying drawings when read in conjunction with embodiments. It should be noted that embodiments of the disclosure and the features thereof can be combined with each other if no conflict is caused.

Embodiment 1

Figure 1:
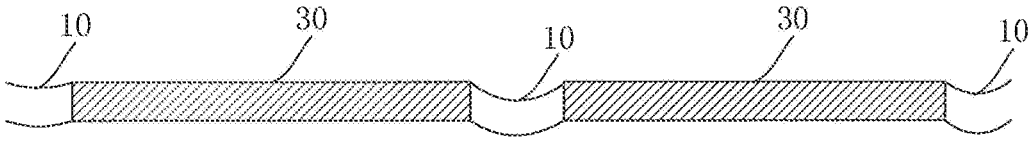
FIG. 1 is a schematic diagram showing the structure of an earphone wire according to an embodiment.

In consideration of the problem that the most of flexible earphone wires having a uniform overall hardness entwine easily and cannot be untangled readily, an earphone is provided in the embodiment to address at least one of the aforementioned technical problems. In the embodiment, an earphone includes an earphone wire. FIG. 1 is a schematic diagram showing the structure of an earphone wire according to an embodiment. As shown in FIG. 1, the earphone wire includes flexible wire parts 10 and hard wire parts 30 which are arranged alternately. During specific implementation, the earphone wire may be hardened in sections, that is, flexible wire parts and hard wire parts are alternately arranged, the flexible wires guaranteeing the flexibility of the whole earphone so that the earphone can be stored conveniently without influencing user experience while the hard wires preventing the entwining of the earphone wire and facilitating the untangling of entwined wires even if the earphone wire entwines.

In a preferred embodiment of the disclosure, the hard wire part 30 may be realized through a local thicken operation, however, as the flexibility and the length of a wire are the basic reasons for the entwining of the wire and the thickening spoils the appearance of the product, the flexible wire parts and the hard wire parts may be arranged in any of the following three ways provided in the embodiment: (1) arrange casing tubes having different hardness outside the internal guide wire of the earphone wire; (2) arrange an integrated casing tube outside the internal guide wire of the earphone wire, wherein the integrated casing tube at positions corresponding to the hard wire parts is hardened; and (3) coat a component which hardly entwines on the hard wire parts.

The hard wire parts 30 and the flexible wire parts 10 may have the same wire diameter or not and preferably have the same wire diameter for the sake of a better overall earphone appearance.

Figure 2:
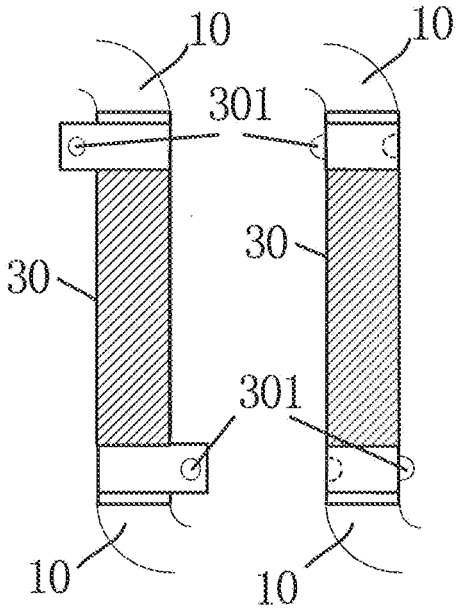
FIG. 2 is a schematic diagram showing the structure of a hard wire part provided with a first connection portion according to an embodiment.

To store the ordinary long earphone in a given length, in a preferred embodiment of the disclosure, the hard wire parts 30 may further include a first connection portion 301 for connecting two hard wire parts 30 detachably, as shown in FIG. 2 which is a schematic diagram showing the structure of the hard wire part provided with a first connection portion according to an embodiment of the disclosure.

The first connection portion 301 may adhere or hind two hard wire parts 30, in a preferred embodiment of the disclosure, lock catches and/or magnets may be symmetrically arranged on each two hard wire parts 30 so as to achieve a simple and reliable connection at a low cost.

As a long earphone wire is not needed in most cases, the lock catches arranged on external surfaces of the hard wire parts and lockable to each other can be locked with each other to shorten the length of the earphone, and the shortened earphone wire consequentially avoids the entwining of the earphone wire.

To be locked better, each two hard wire parts 30 on which the lock catches are arranged have the same length.

Figure 3:
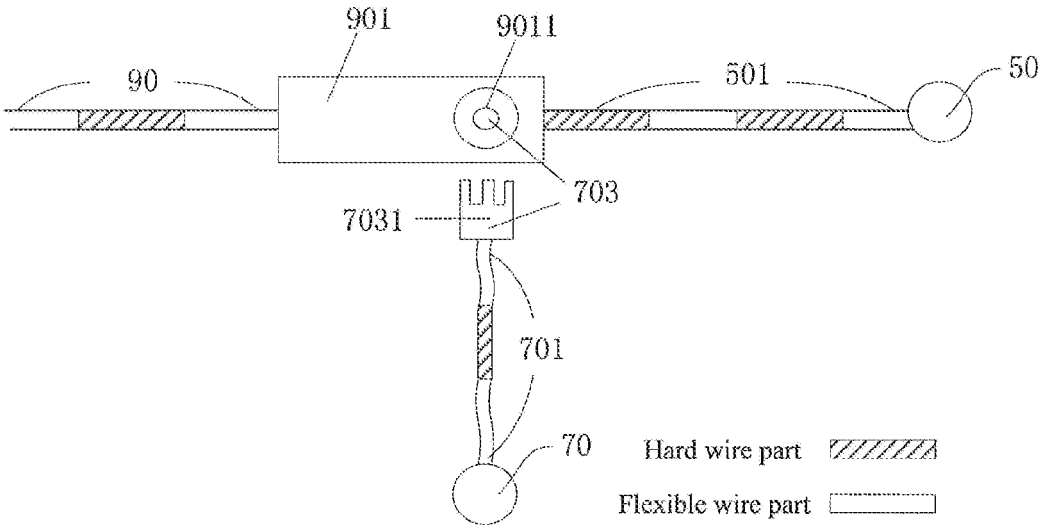
FIG. 3 is a schematic diagram showing the structure of a detachable second earplug branch according to an embodiment.

In a preferred embodiment, the earphone wire may include: a first branch wire 501 corresponding to a first earplug 50, a second branch wire 701 corresponding to a second earplug 70 and a trunk wire 90, as shown in FIG. 3 which is a schematic diagram showing the structure of a detachable second earplug branch according to an embodiment of the disclosure; to shorten the effectively used wire, the first connection portion 307 may be arranged on the trunk wire 90.

In a preferred embodiment, a second connection portion 703 is arranged on the second branch wire 701 in such a manner that the second connection portion 703 is detachably connected with the trunk wire 90. In this way, the second earplug 90, only when being used (e.g. used to listen to music), is connected with the trunk wire 90. For example, in view of the fact that mobile phone users mainly use an earphone to answer a call, which can be completed with a single earplug, the second earplug branch wire may be formed in a detachable form, and experiences show that a single earplug is better in anti-entwining effect, and the second earplug branch is assembled if the user needs to listen to music.

Figure 4:
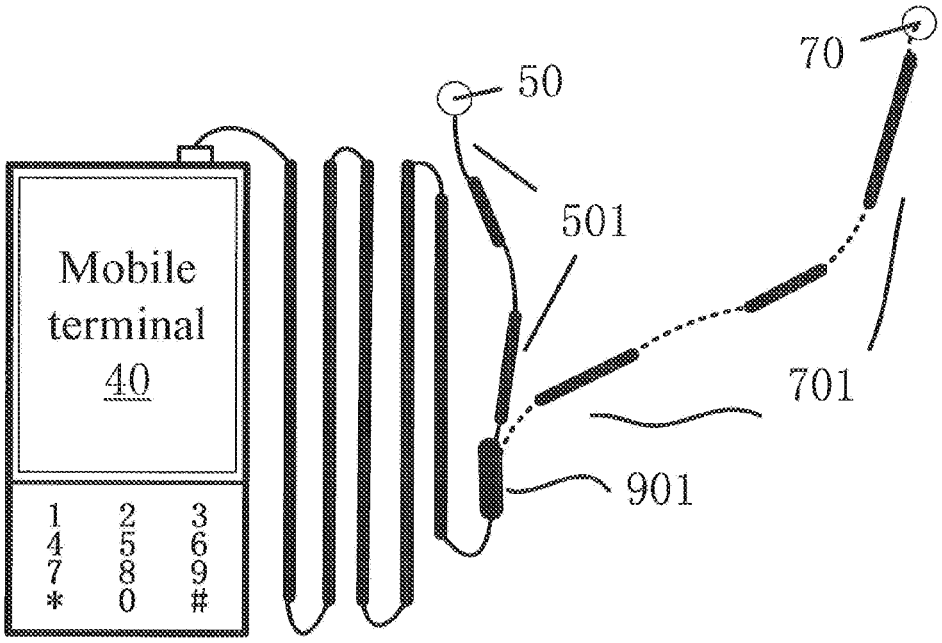
FIG. 4 is a schematic diagram showing an earphone use state according to an embodiment.

The second connection portion 703 may be implemented as a plug-socket form, in a preferred embodiment of the disclosure, the earphone further includes: a microphone box 901 arranged on the earphone wire, wherein as shown in FIG. 3 and FIG. 4, corresponding to the plug, a socket 9011 matching with the plug 7031 is arranged on the microphone box, to detachably connect the second branch wire 701 with the trunk wire 90.

Embodiment 2

Structurally different from ordinary earphone wires, the earphone wire disclosed herein is fabricated in a different way, thus, an earphone fabrication method is provided in an embodiment of the disclosure to form the earphone, specifically, the earphone fabrication method includes: arranging flexible wire parts and hard wire parts alternately on an earphone wire of the earphone.

In the embodiment, the flexible wire parts and the hard wire parts are arranged in at least one of the following ways: arranging casing tubes having different hardness outside the internal guide wire of the earphone wire; arranging an integrated casing tube outside the internal guide wire of the earphone wire, wherein the integrated casing tube at positions corresponding to the hard wire parts is hardened; and coating a component which hardly entwines on the hard wire parts, as stated above.

Embodiment 3

A preferred implementation of the earphone is provided in the embodiment to describe foregoing embodiments in a preferable manner.

Different from ordinary earphones the whole earphone wire of which is flexible, the earphone wire provided in the embodiment consists of alternately arranged hard wire sections and flexible wire sections (that is, flexible wire parts 10 and hard wire parts 30 are arranged alternately), as shown in FIG. 1, wherein the proportion of the hard wires (hard wire parts 30) to the flexible wires (flexible wire parts 10) and the lengths of the hard wires and the flexible wires are changed according to specific design requirements. For example, for an earphone for mobile phones, the length of each hard wire section may be approximate to that of a mobile phone while that of each flexible wire section is smaller. The longer each hard wire section is, the more unlikely the earphone entwines, however, the flexibility of the earphone is reduced and the earphone is less convenient to use. The length of each flexible or hard wire section and the interval at two flexible or hard wire sections may be the same or not, however, to lock hard wires with each other, it is preferably that lockable hard wire sections have the same length.

For the sake of a better appearance of the product, the hard wire sections (hard wire parts 30) and the flexible wire sections (flexible wire parts 10) may have the same wire diameter, to achieve this effect, casing tubes having the same diameter but different hardness may be sleeved on the internal guide wire of the earphone, the casing tube on the flexible wire section is soft while that on the hard wire section is hard, or an integrated casing tube may be used, and the part of the integrated casing tube corresponding to the hard wire section is hardened. Alternately, a sheet such as a metal foil or a thin plastic film, which hardly entwines, is coated on the hard wire section, which causes no substantial influence on the consistency of wire diameters. If the hard wire section and the flexible wire section are different in wire diameter, then the hard wire section is thickened and hardened.

As shown in FIG. 2, a first connection portion 301 may be arranged at both ends of the hard wire section, and in the embodiment, the first connection portions are lock catches with which the hard wire sections are locked with each other to shorten effective earphone wire. In the embodiment, the first connection section is arranged at two ends or in the middle of the hard wire section; alternately, the first connection sections are magnets with which hard wire sections can be locked with each other and cannot be unlocked without the aid of an external force.

As shown in FIG. 3, a microphone box 901, in which a microphone and some control circuits are arranged, is arranged on the earphone wire of an ordinary mobile phone, a second earplug socket 9011 may be arranged on the circuits, and a corresponding plug 7031 is assembled at the terminal of the second branch wire 701 corresponding to the second earplug so that the two earplugs can be assembled when needed and the second branch wire 701 can be detached to use a single earplug to, for example, make or answer a call. Apparently, the second earplug socket 9011 may be arranged between the microphone 901 and the first earplug (that is, on the first branch wire 501) or between the microphone box and an earphone plug, but not be on the microphone box 901. The second earplug branch wire may be locally hardened or not. In the scheme shown in FIG. 3, the connector is of a jack type, or a contact pin type or a screw type.

FIG. 4 is a schematic diagram showing an earphone use state according to an embodiment. As shown in FIG. 4, the earphone is connected with a mobile terminal 40. It should be noted that although flexible wire parts and hard wire parts are arranged alternately through a local hardening operation, the disclosure is not limited to this, and as stated above, in consideration of the appearance of the earphone, the hard wire parts and the flexible wire parts may have the same wire diameter.

The mentioned above is only preferred embodiments of the disclosure but not limitation to the disclosure, it should be appreciated that various modification and variations can be devised by those of ordinary skill in the art. Any modification, substitute or improvement devised without departing from the spirit and scope of the disclosure should fall within the protection scope as defined by the appended claims of the disclosure.

What is claimed is:

1. An earphone, comprising:

an earphone wire, wherein the earphone wire comprises flexible wire parts and hard wire parts which are arranged alternately, and wherein each of two of the hard wire parts include a first connection portion, the first connection portions structured so that the first connection portions are detachably connectable to one another to detachably connect the two hard wire parts together.

2. The earphone according to claim 1, wherein the flexible wire parts and the hard wire parts are arranged in at least one of the following ways:

arranging casing tubes having different hardness outside an internal guide wire of the earphone wire;

arranging an integrated casing tube outside the internal guide wire of the earphone wire, wherein the integrated casing tube at positions corresponding to the hard wire parts is hardened; and coating a component which hardly entwines on the hard wire parts.

3. The earphone according to claim 2, wherein the flexible wire parts and the hard wire parts have the same wire diameter.

4. The earphone according to claim 1, wherein the first connection portion comprises:

lock catches and/or magnets which are symmetrically arranged on each of two hard wire parts.

5. The earphone according to claim 4, wherein the hard wire parts on which the lock catches are provided have a same length.

6. The earphone according to claim 5, wherein the earphone wire comprises: a first branch wire corresponding to a first earplug, a second branch wire corresponding to a second earplug and a trunk wire, and the first connection portion is arranged on the trunk wire.

7. The earphone according to claim 4, wherein the earphone wire comprises: a first branch wire corresponding to a first earplug, a second branch wire corresponding to a second earplug and a trunk wire, and the first connection portion is arranged on the trunk wire.

8. The earphone according to claim 1, wherein the earphone wire comprises: a first branch wire corresponding to a first earplug, a second branch wire corresponding to a second earplug and a trunk wire, and the first connection portion is arranged on the trunk wire.

9. The earphone according to any claim 1, wherein the earphone wire further comprises: a first branch wire corresponding to a first earplug, a second branch wire corresponding to a second earplug and a trunk wire, wherein a second connection portion is arranged on the second branch wire, and the second connection portion is detachably connected with the trunk wire.

10. The earphone according to claim 9, wherein the second connection portion is a plug, the earphone further comprises a microphone box arranged on the earphone wire, wherein a socket matching with the plug to detachably connect the second branch wire with the trunk wire is arranged on the microphone box.

11. A fabrication method for an earphone, comprising:

arranging flexible wire parts and hard wire parts alternately on an earphone wire of the earphone; and positioning a first connection portion on each of two of the hard wire parts, the first connection portions structured so that the first connection portions are detachably connectable to one another to detachably connect the two hard wire parts together.

12. The method according to claim 11, wherein the flexible wire parts and the hard wire parts are arranged in at least one of the following ways:

arranging casing tubes having different hardness outside an internal guide wire of the earphone wire;

arranging an integrated casing tube outside the internal guide wire of the earphone wire, wherein the integrated casing tube at positions corresponding to the hard wire parts is hardened; and coating a component which hardly entwines on the hard wire parts.

* * * * *